US006969136B1

(12) United States Patent
Matsumoto et al.

(10) Patent No.: US 6,969,136 B1
(45) **Date of Patent: *Nov. 29, 2005**

(54) INK CARTRIDGE, INK-JET PRINTING APPARATUS, AND REFILLING DEVICE

(75) Inventors: Hitoshi Matsumoto, Tokyo (JP); Takahiro Naka, Tokyo (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/318,268

(22) Filed: May 25, 1999

(30) Foreign Application Priority Data

May 25, 1998 (JP) ..... 10-158658
May 25, 1998 (JP) ..... 10-158659
Jul. 18, 1998 (JP) ..... 10-219875

(51) Int. Cl.[7] ..... B41J 29/393
(52) U.S. Cl. ..... 347/7; 347/19; 347/23
(58) Field of Search ..... 347/85, 86, 5–7, 347/9, 14, 19, 84, 87, 23

(56) References Cited

U.S. PATENT DOCUMENTS 5,365,312 A 11/1994 Hillmann et al.
5,504,510 A 4/1996 Miyakawa
5,519,418 A 5/1996 Nishikawa et al.
5,550,956 A * 8/1996 Tadokoro ..... 395/113
5,610,635 A 3/1997 Murray et al. ..... 347/7
5,663,750 A * 9/1997 Sakuma ..... 347/7
5,699,091 A 12/1997 Bullock et al. ..... 347/19
5,726,692 A 3/1998 Yamaguchi et al.
5,788,388 A * 8/1998 Cowger et al. ..... 347/19
5,812,156 A * 9/1998 Bullock et al. ..... 347/19
5,949,447 A 9/1999 Arai et al.
6,000,773 A * 12/1999 Murray et al. ..... 347/7
6,000,778 A * 12/1999 Koitabashi et al. ..... 347/23
6,036,304 A * 3/2000 Emanuel ..... 347/84
6,045,206 A * 4/2000 Igval ..... 347/2
6,102,517 A 8/2000 Kobayashi et al.
6,116,716 A 9/2000 Tajika et al.
6,126,265 A * 10/2000 Childers et al. ..... 347/23
6,142,600 A 11/2000 Takahashi et al.
6,158,850 A * 12/2000 Cook ..... 347/85
6,161,913 A * 12/2000 Childers et al. ..... 347/19
6,170,937 B1 * 1/2001 Childers et al. ..... 347/85
6,227,638 B1 * 5/2001 Childers et al. ..... 347/7
6,227,643 B1 * 5/2001 Purcell et al. ..... 347/19
6,361,138 B1 * 3/2002 Seino et al. ..... 347/19
6,375,301 B1 * 4/2002 Childers et al. ..... 347/19

FOREIGN PATENT DOCUMENTS

EP 0720916 A2 7/1996
EP 0 778 140 A2 6/1997 ..... B41J 2/165

(Continued)

*Primary Examiner*—Lamson Nguyen
*Assistant Examiner*—Blaise Mouttet
(74) *Attorney, Agent, or Firm*—Sughrue Mion, PLLC

(57) ABSTRACT

An ink cartridge for an ink jet type printing apparatus having a print head, the ink cartridge including: a container having an ink chamber for containing ink therein; an ink supply port for ejecting the ink from the ink chamber to the print head; a memory device for storing data related to the ink or the ink cartridge, the memory device has an area in which the data is stored in a rewritable manner; and a contact device enabling the transmission of data between the memory device and an external device. The memory device may include data indicative of the history of the ink cartridge which may be utilized to control a reproduction of the ink cartridge.

43 Claims, 10 Drawing Sheets

FOREIGN PATENT DOCUMENTS

| | | | | |
|---|---|---|---|---|
| EP | 0 789 322 | A2 | 8/1997 | ..... G06K 15/00 |
| EP | 0 812 693 | A1 | 12/1997 | |
| EP | 841 173 | * | 5/1998 | ..... B41J 2/175 |
| EP | 854 044 | A2 * | 7/1998 | ..... B41J 2/175 |
| JP | 4-500482 | A | 1/1992 | |
| JP | 6-126981 | | 5/1994 | ..... B41J 2/175 |
| JP | 6-126981 | A | 5/1994 | |
| JP | 06-155758 | | 6/1994 | |
| JP | 6-191055 | A | 7/1994 | |
| JP | 6-320732 | A | 11/1994 | |
| JP | 7-232438 | | 9/1995 | ..... B41J 2/175 |
| JP | 07-266578 | | 10/1995 | |
| JP | 8-174863 | A | 7/1996 | |
| JP | 08-224891 | | 9/1996 | |
| JP | 08-230213 | | 9/1996 | |
| JP | 8-238824 | A | 9/1996 | |
| JP | 8-310007 | | 11/1996 | ..... B41J 2/175 |
| JP | 09-058014 | | 3/1997 | |
| JP | 9-300645 | A | 11/1997 | |
| JP | 9-309213 | A | 12/1997 | |
| JP | 9-314861 | A | 12/1997 | |
| JP | 10-006527 | | 1/1998 | |
| JP | 10-024612 | | 1/1998 | |
| JP | 10-109431 | A | 4/1998 | |
| WO | WO 90/00974 | | 2/1990 | ..... B41J 3/04 |
| WO | WO 97/023352 | | 7/1997 | |
| WO | WO 98/04414 | | 2/1998 | ..... B41J 2/17 |

* cited by examiner

INK CARTRIDGE, INK-JET PRINTING APPARATUS, AND REFILLING DEVICE

BACKGROUND OF THE INVENTION

1. Field of the Invention

The present invention relates to an ink jet type printing apparatus which is supplied with ink from a replaceable ink cartridge, and ejects ink droplets from nozzle openings onto a recording medium for achieving the printing. The present invention also relates to an ink cartridge and an ink refilling device suited for use with the printing apparatus.

2. Related Art

A conventional ink-jet printing apparatus includes, for example, a print head, and an ink cartridge for supplying ink to the print head. In the print head, a drive signal is applied to a piezoelectric vibrator or heating device in accordance with print data, and the ink within a pressure-generating chamber is activated by the energy, generated by the piezoelectric vibrator or the heating device, thereby ejecting ink droplets from nozzle openings.

The print quality is determined by the resolution of the print head, and besides is much influenced by the viscosity of ink and the degree of spreading (running) of ink on the recording medium. Therefore, in order to improve the print quality, the characteristics of the ink, as well as the drive signal to be applied to the print head, have been improved, and besides in order to prevent the clogging of the nozzle openings, maintenance conditions, such as the period of blank ejection and the ejection in a capped condition, have been improved.

Thus, when the characteristics of the ink and the print head-driving method are both suitably determined, the quality of the printing by the printing apparatus is improved. Such technical developments may be achieved by designing new ink-jet printing apparatus to be manufactured, but for applying such achievements to printing apparatus already off the manufacturer, the printing apparatus must be brought to the manufacturer, and then memory device, storing control data, must be improved also. This is hardly possible practically, however, in view of the cost and the intricate process during manufacturing required.

Therefore, it has been proposed a method as disclosed in Japanese Patent Unexamined Publication No. 5-193127, in which an ink cartridge is provided with a memory device, and characteristics of ink, the amount of the ink, drive conditions and so on are stored in the memory device, whereas in a printing apparatus, the drive conditions are adjusted in accordance with this information.

Incidentally, in view of the preservation of the environment, the manufacturers have now been required to recover as much as possible ink cartridges and cartridges with a print head, which have heretofore been discarded as consumable goods, and therefore a study has been made of refilling the recycled ink cartridges so that they can be recycled.

However, the ink cartridges, brought into users' possession, are used in various manners, and therefore the recycled ink cartridges are varied greatly in quality, and the regenerating processing can not be effected uniformly for such recycled products in contrast with the case of producing virgin products.

SUMMARY OF THE INVENTION

The invention has been made in view of the problems and difficulties accompanying the conventional art, and an object of the invention is to provide an ink cartridge which, when recycled, can be reused while maintaining a high quality.

Another object of the invention is to provide a printing apparatus suitable for such ink cartridge.

A further object of the invention is to provide a cartridge reproducing device suited for the above ink cartridge.

The above and other objects can be achieved by a provision of an ink cartridge which, according to the present invention, includes a container having an ink chamber for containing ink, and an ink supply port for ejecting the ink from the ink chamber to a print head; memory device for storing data related to the ink; and contact device enabling the transmission of data between the memory device and an external device, wherein the memory device has an area in which data, related to a history of use of the ink cartridge, can be stored in a rewritable manner.

The conditions of use of the ink cartridge by the user are stored in the memory device, and therefore at the time of reproducing the ink cartridge, the reproduction processing, suited for the ink cartridge, can be effected in accordance with the data in the memory device.

DESCRIPTION OF THE PREFERRED EMBODIMENTS

The present invention will now be described in detail with reference to the drawings.

Figure 1A:
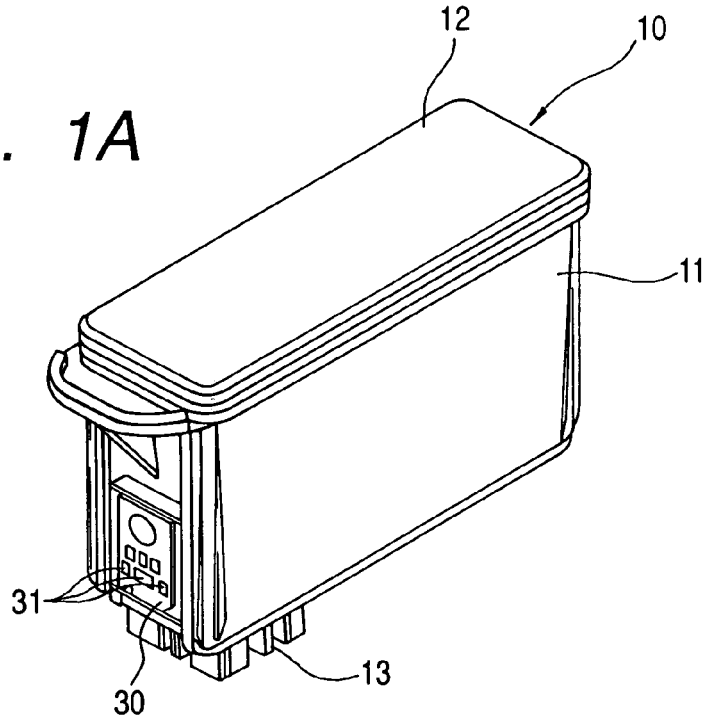
FIGS. 1A and 1B are views showing preferred embodiments of ink cartridges of the present invention, respectively.
Figure 1B:
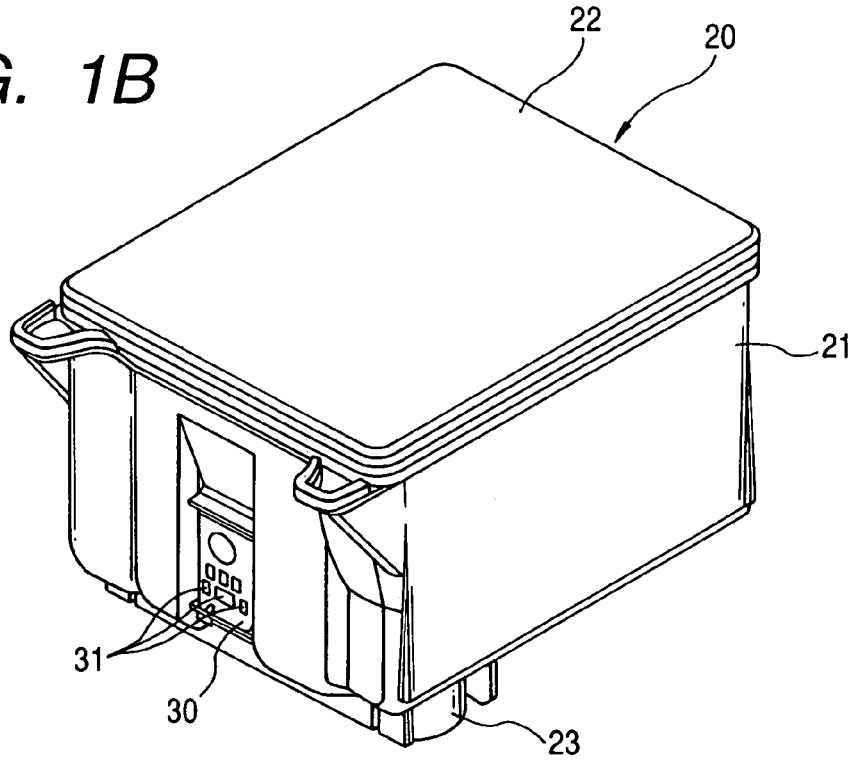

FIG. 1 show preferred embodiments of ink cartridges 10 and 20 suited for an ink-jet printing apparatus of the present invention. A container 11, 21 contains ink, and an upper side thereof is sealed by a lid 12, 22. A porous member is filled in the container 11, 21, and is impregnated with the ink.

An ink supply port 13, 23 is formed at the bottom surface of the container 11, 21, and when the container is mounted on a carriage 42, the ink supply port 13, 23 is hermetically engaged with ink supply needle (needles) 44, 45. A circuit board 30 is fixedly mounted on one side surface of the container 11, 21.

Figure 2A:
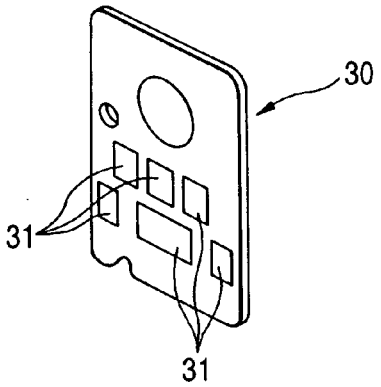
FIGS. 2A and 2B are views showing a front and rear sides of a circuit substrate mounted on the ink cartridge shown in FIGS. 1A and 1B.
Figure 2B:
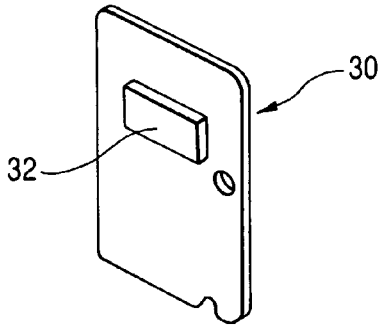

Contacts 31 for electrical contact with the printing apparatus are formed on that side of the circuit board 30, as shown in FIGS. 2(*a*) and 2(*b*), which serves as an outer surface when the circuit board 30 is mounted on the ink cartridge. Semiconductor memory device 32 is mounted in an accessible manner on that portion of the outer surface of the circuit board 30 which does not prevent the formation of the contacts 31.

Fixed data, such as the production date, the lifetime and the number of refilled times that can be made, are stored in the semiconductor memory device 32, and besides the following data and character series directly relating to those data can be stored in a rewritable manner in predetermined areas of this memory device 32:

(1) The number of refilled times of the ink cartridge.

(2) Maintenance conditions such as the condition of cleaning of the ink cartridge and the condition of exchange of parts at the time the ink cartridge is refilled.

(3) Conditions of use such as the time of final use of the ink cartridge, the time of the final ink end, and the environment of use of the ink cartridge.

In a case where the various kinds of data are stored by means of the character series data, the printing apparatus is designed to store data for interpreting the character series data. Accordingly, the memory capacity of the memory device 32 can be reduced remarkably.

Figure 3:
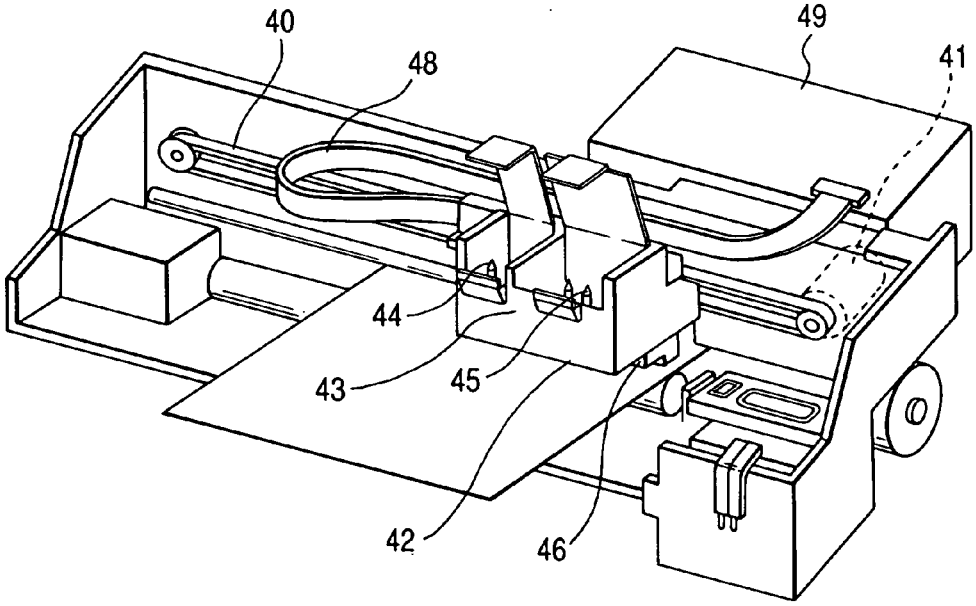
FIG. 3 is a view showing a printing mechanism portion of a printing apparatus employing the ink cartridges.

FIG. 3 shows one example of a printing mechanism portion of the printing apparatus. The carriage 42 is connected to a drive motor 41 via a timing belt-40, and a holder 43 for holding the ink cartridge 10, containing black ink, and the ink cartridge 20, containing color inks, is formed at the upper side of the carriage 42, and a print head 46 for being supplied with the inks from the ink cartridges 10 and 20 through the ink needles 44 and 45 is provided at the lower surface of the carriage 42.

Figure 4:
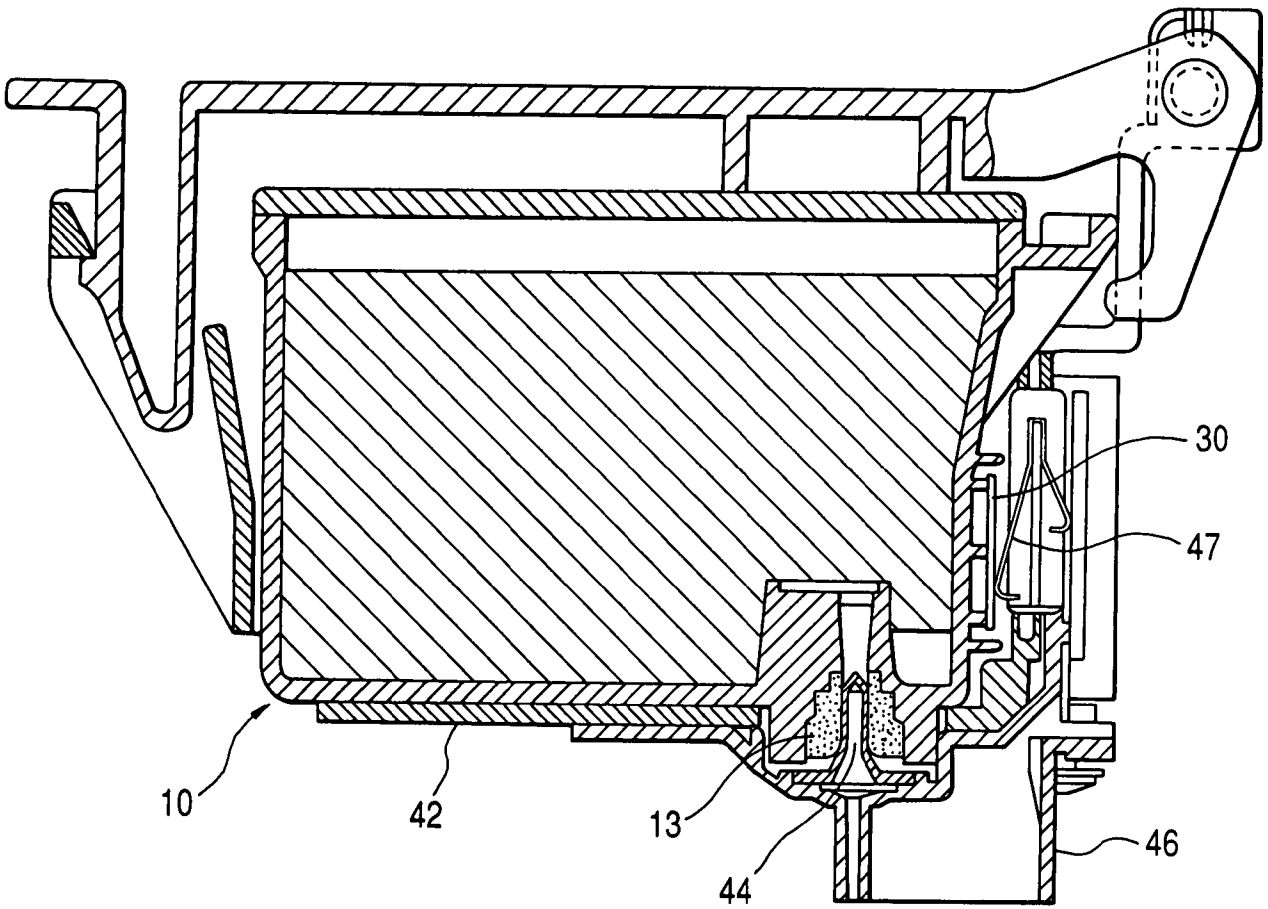
FIG. 4 is a cross-sectional view showing a condition in which the ink cartridge is mounted onto a carriage.

FIG. 4 shows the cross-sectional construction showing the condition of attachment of the ink cartridges to the carriage, using the black ink cartridge 10 as an example. When the ink cartridge 10 is properly connected to the ink supply needle 44, the contacts 31 of the circuit board 30 are connected to contacts 47 of the carriage 42, so that the ink cartridge 10 is connected to a control device 49 via a flexible cable 48, and the ink cartridge 10 is accessible from the control device 49.

Figure 5:
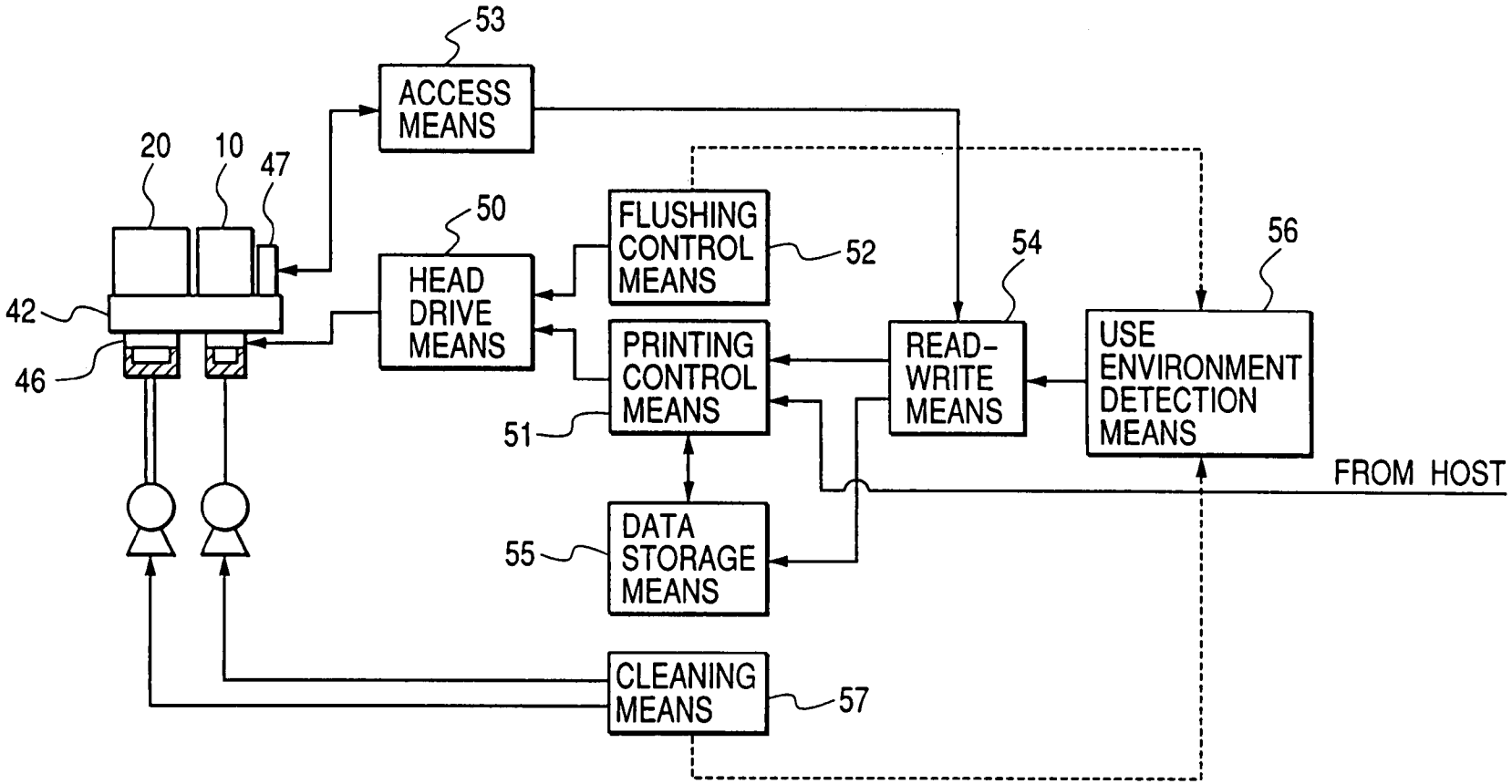
FIG. 5 is a block diagram showing one example of a control device for controlling the operation of the above device.

FIG. 5 shows one example of a control device 49. Based on a signal from a host, head drive device 50 causes ink droplets to eject from the print head 46 in accordance with instruction signals from printing control device 51 and flushing control device 52 (for eliminating the clogging).

When the drive conditions and so on are stored in the memory device 32, the printing control device 51 reads the optimum drive conditions for the ink cartridge 10, 20 via access means 53, and effects the printing control. By doing so, even for a reproduced recycle product, the default drive conditions are determined such that the drive signal to be fed to the print head 46 can be adjusted so that the ink droplets can eject in the optimum amount, as described later.

Read-write control device 54 writes data, stored in data storage memory 55 onto the memory device 32 of the ink cartridges 10 and 20. The data storage memory 55 stores data related to the environment of use of the printing apparatus, detected by use environment detection means 56, the flushing operation by the flushing control device 52, and the cleaning operation by cleaning control device 57.

Figure 6:
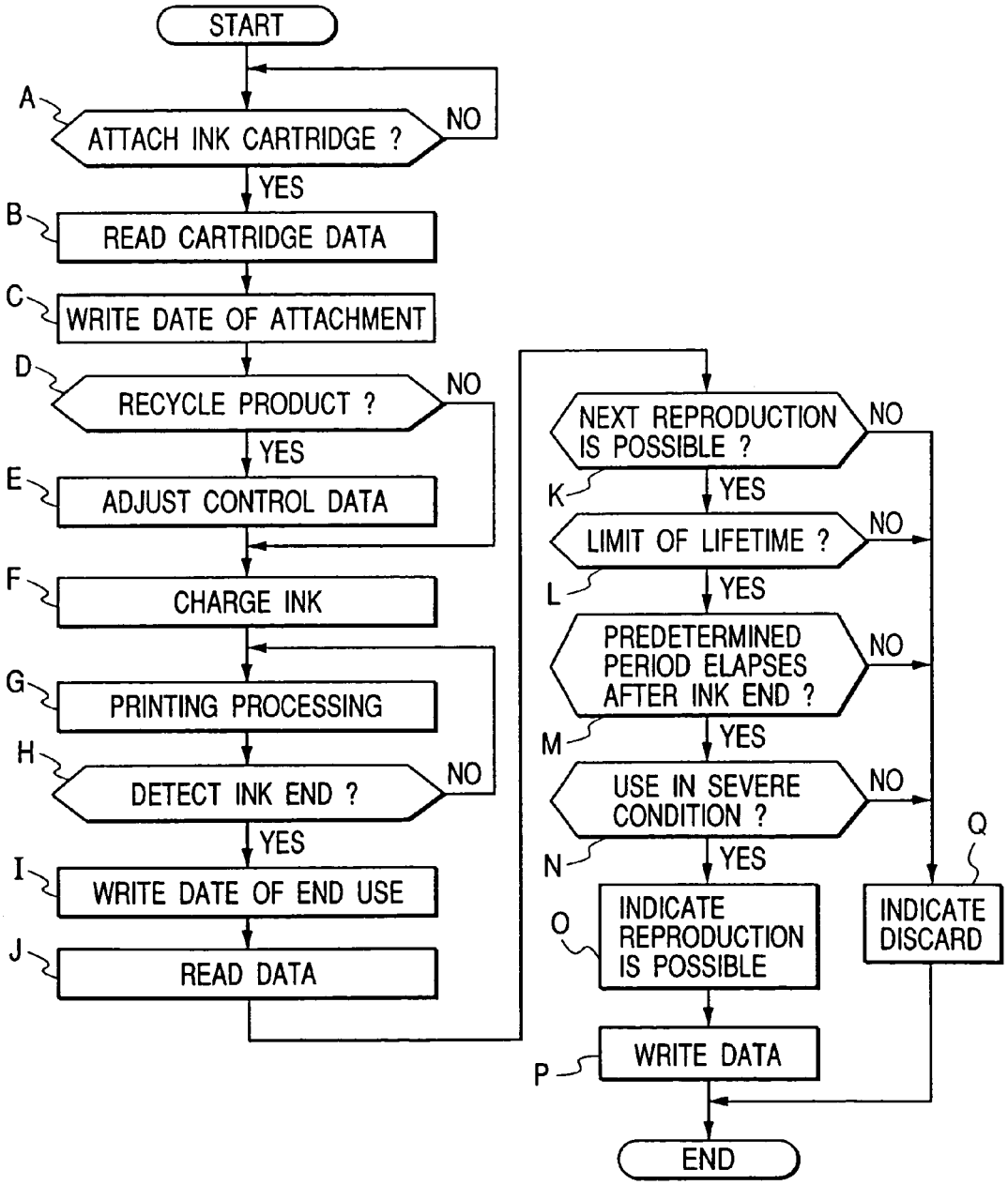
FIG. 6 is a flow chart showing the operation of the above device.

Next, the manner of use of the ink cartridges 10 and 20 of the above construction will be described with reference to a flow chart of FIG. 6.

When the ink cartridge 10, 20 is mounted onto the carriage 25 42, the printing control device 51 reads cartridge data stored in the semiconductor memory device 32 of the ink cartridge 10, 20 (Step B), and data indicative of the time of attachment is stored onto the semiconductor memory device 32 of the ink cartridge 10, 20 (Step C), and then it is judged from the number of reproducing time whether or not the cartridge is one to be reproduced (Step D). If the cartridge is one to be reproduced, the control data is adjusted (Step E).

If the cartridge is a fresh one, ink in the ink cartridge 10, 20 is supplied to the print head 46 under the default condition (Step F), and the printing processing is effected (Step G). On the other hand, if the cartridge to be reproduced, the data in the data storage memory 55 is adjusted and renewed in accordance with the cartridge data, and the ink charging is effected (Step F). By doing so, ink in the reproduced cartridge, which is somewhat lower in reliability than the virgin cartridge, is charged into the print head 46 in such a manner as not to degrade the printing quality, for example, by increasing the amount of drawing of the ink (Step F).

The ink in the ink cartridge 10, 20 is consumed as a result of the printing operation and the clogging prevention operation, and when the ink end is detected (Step H), data indicative of the time of the ink end is stored as cartridge data (Step I) in the semiconductor memory device 32 of the ink cartridge 10, 20 under the control of the printing control device 51. When attaching the ink cartridge, it is judged from the number of reproduction read (Step J) whether or not the next reproduction is possible (Step K), whether or not the cartridge container has reached the limit of the lifetime (Step L), whether or not a predetermined time period has elapsed after the ink end of the ink cartridge was detected (Step M), and whether or not the environment of use, monitored by the use environment detection means 56, has adversely affected the ink cartridge (Step N).

According to the embodiment described above, the semiconductor memory device 32 stores therein fixed data such as production date, lifetime, the possible number of reproduction, and the other data such as the actual number of reproduction applied to the subject ink cartridge, cleaning condition during the reproduction of the ink cartridge, maintenance condition such as exchange of parts, the latest usage time of the ink cartridge, the time of the ink end, the usage condition or environment of the ink cartridge. In addition, the memory device may also store therein a preset minimum ink amount to be held in the ink cartridge. That is, the minimum amount of ink is stored at the time when the ink cartridge is shipped from the factory, and the residual amount of ink when the ink cartridge is mounted on the printing device is recorded. Those data are read out to prevent the printhead from being damaged.

Figure 7:
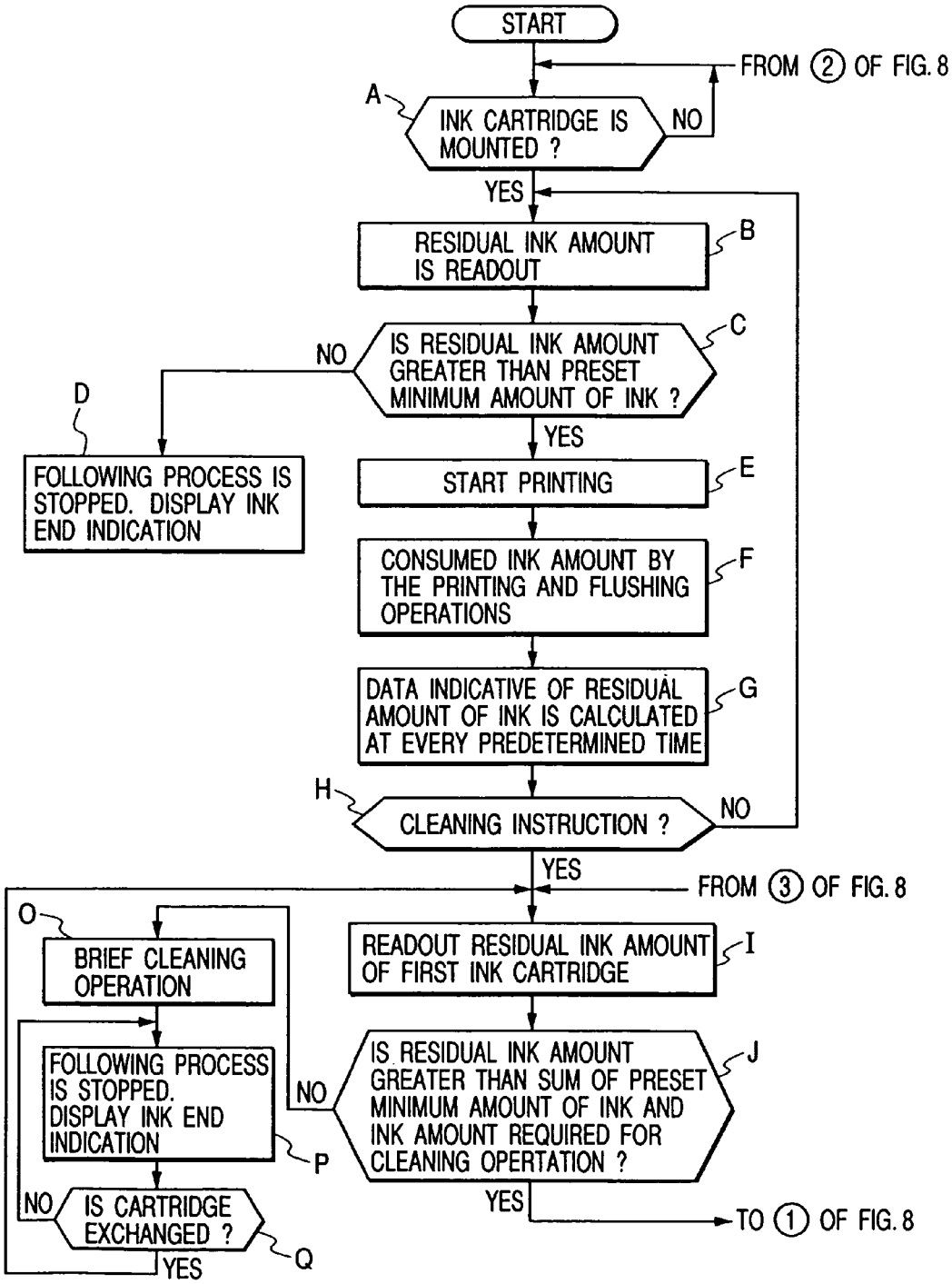
FIG. 7 is a flowchart showing a main operation and a process of one ink cartridge in the cleaning process for the printing apparatus of the present invention.
Figure 8:
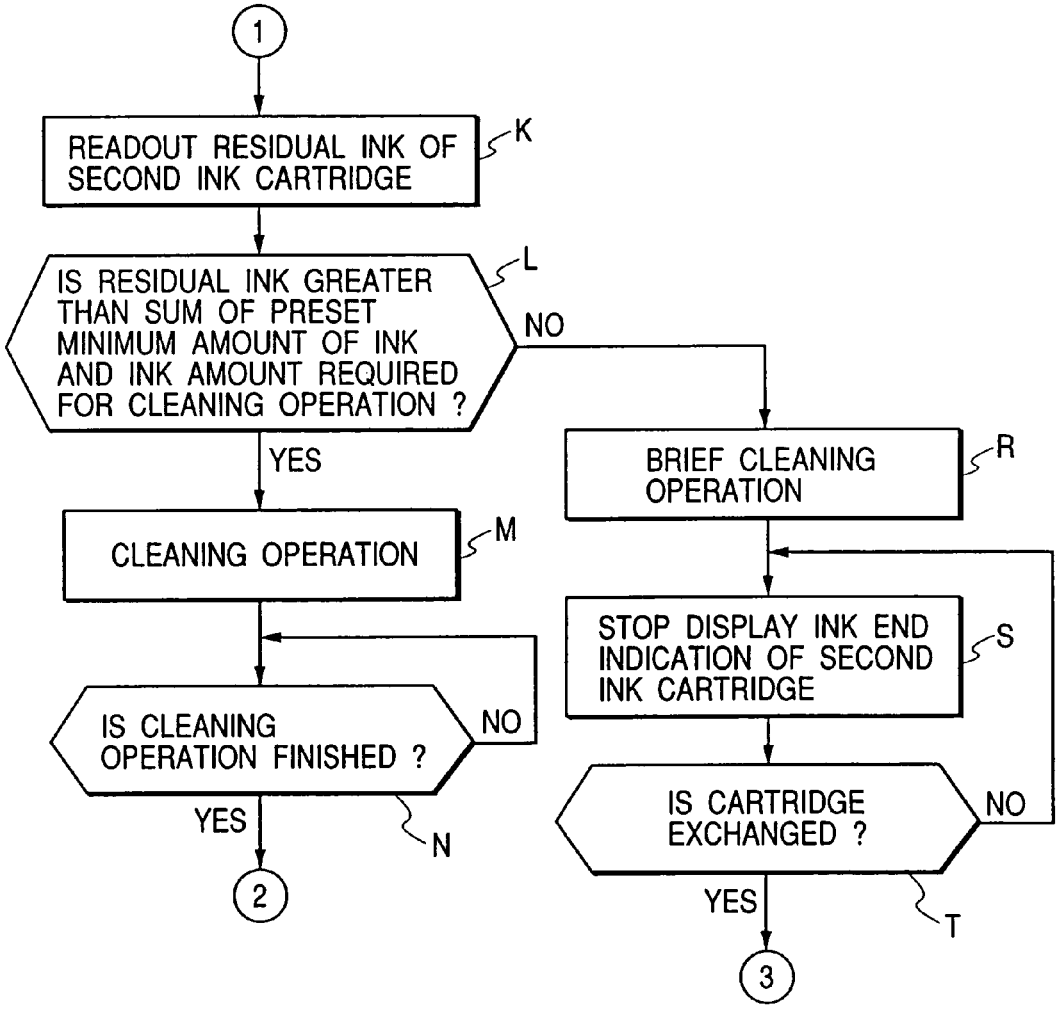
FIG. 8 is a flowchart showing a process of the other ink cartridge in the cleaning process for the printing apparatus of the present invention.

FIGS. 7 and 8 are flowcharts showing the operation applied to the ink cartridge described above with reference to a printing apparatus mounting thereon two different ink cartridges, i.e., one is for black and the other is for color printing.

When two ink cartridges 10, 20 are mounted on a carriage 42 (STEP A), a read-write control device 54 reads out data of a current residual ink and a preset minimum amount of ink from a semiconductor memory device 32 of each of the ink cartridges 10, 20 (STEP B), and then the control device 54 compares the data with each other (STEP C).

As a result of the comparison, when the residual ink is smaller than the preset minimum amount of ink, an ink end indication is displayed on the printing apparatus or a display device of the host computer without processing the following operations (STEP D).

On the other hand, when the residual ink amount is greater than the preset minimum amount of ink, a print control device 51 executes the print operation at the time when a print instruction signal is inputted (STEP E). The number of ink droplets ejecting in accordance with the print instruction signal from the printhead 46 are counted to calculate the ink amount which is consumed by the printing operation. A flushing control device 52 executes a so called flushing operation for preventing the nozzle openings from being clogged. During the flushing operation ink droplets are ejected every time when a predetermined quantity of printing has been performed or predetermined time expires. The ink ejection by the flushing operation does not contribute to the printing. However, the ink droplets ejecting during the flushing operation are also counted and the consumed amount of ink in the ink cartridges 10, 20 are calculated (STEP F). Subsequently, every time when the printing operation is temporally suspended, for example, a printing of one page is finished, the residual amount of ink is calculated and the data is stored in the semiconductor memory device 32 of each of the cartridges 10, 20 (STEP G).

When the printing operation continues for a long time and a print failure is occurred, an operator may instruct a cleaning operation or the control device automatically generates a cleaning instruction signal (STEP H). If the cleaning operation is instructed, a residual ink amount stored in the semiconductor memory device 32 of one of the ink cartridge, for example, a first ink cartridge 10, is read out (STEP I). Subsequently, the read-out residual amount of ink is compared with a sum of the preset minimum amount of ink stored in the semiconductor memory device 32 of the first ink cartridge and an ink amount to be consumed by the cleaning operation (STEP-J).

When the residual ink in the first ink cartridge is sufficient, subsequently, data of a residual amount of ink stored in the semiconductor memory device 32 of the second ink cartridge 20 is read out (STEP K). Then the read-out residual amount of ink is compared with a sum of the preset minimum amount of ink stored in the semiconductor memory device 32 of the second ink cartridge and an ink amount to be consumed by the cleaning operation (STEP L).

Under the operation as described above, when both the ink cartridges contain therein sufficient amount of ink, the cleaning control device 57 executes a normal cleaning operation which requires relatively large quantity of ink (STEP M). After the normal cleaning operation is finished (STEP N), the process goes back to STEP A.

On the other hand, when the residual amount of ink in any one of the ink cartridges is smaller than the sum of the preset minimum ink amount stored in the semiconductor memory device 32 of the respective ink cartridge 10, 20 and the ink amount to be consumed by the normal cleaning operation, the cleaning control device 57 executes a brief cleaning operation which requires less ink than that by the normal cleaning operation (STEPs O, R). In this operation, an ink end condition is displayed with respect to the ink cartridge which suffers the shortage of ink, so that the apparatus offers a user to replace the ink cartridge with a new one (STEPs S, P). When the ink cartridge is replaced with a new cartridge full of ink following the display indicative of the shortage of ink (STEPs Q, T), the process goes back to STEP I where the cleaning operation is resumed.

Further, in STEP T, when a new ink cartridge is mounted on the printhead, new ink is supplied to the printhead from the new ink cartridge. Because the brief cleaning operation has been performed before replacing the old ink cartridge, the clogging problem at the nozzle openings might have been fixed to some extent. Accordingly, the ink supply to the printhead from a new ink cartridge can be achieved assuredly and smoothly compared with a case in which the old ink cartridge is replaced without performing a brief cleaning operation.

In this case, because a part of the cleaning has been carried out before replacing the ink cartridge, it is preferable that the resumed normal cleaning operation should be performed at the reduced amount of ink which has been consumed in the previous cleaning operation performed with the old ink cartridge.

According to the above embodiment, the possibility of the cleaning operation is determined in accordance with the preset minimum ink amount stored in the semiconductor memory device 32 of the ink cartridges 10, 20 at the time when the ink cartridge is shipped from the factory. Accordingly, the optimum minimum ink amount can be preset corresponding to the drying speed of ink and variation of the volatile speed of the ink solvent or the like. As a result, the apparatus can be prevented from the problems that the print head is damaged by the white dot, i.e., ejection of no-ink, and an erroneous ink end indication is displayed while a large amount of ink is still remained in the ink cartridge.

In addition, in the embodiment described above, if the residual amount of ink is small, the brief cleaning operation is performed so that the ink is effectively consumed. However, it may be applicable that the brief cleaning operation is not carried out, i.e., the STEPs O and R are omitted, and the following process is stopped while displaying the ink end indication and waiting for the replacement of the ink cartridge.

Figure 9:
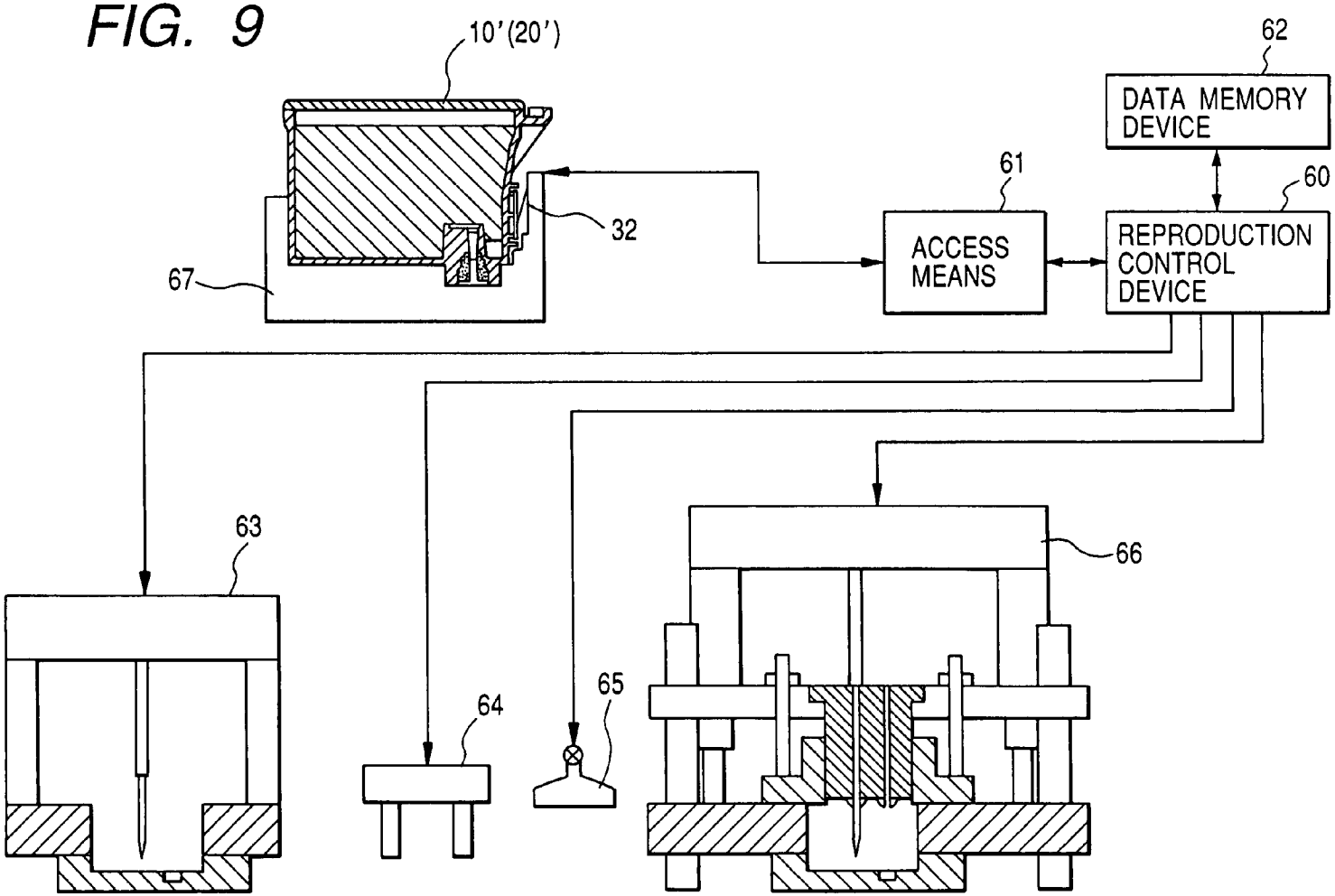
FIG. 9 is a view showing one embodiment of an ink refilling device.

FIG. 9 shows one preferred embodiment of a cartridge reproducing device. Reproduction control device 60 reads data from the semiconductor memory device 32 of the recycled ink cartridge 10', 20' through access means 61, and controls ink discharge means 63, parts exchange means 64, cleaning means 65 and ink charge means 66 in accordance with evaluation data stored in data storage means 62, and in accordance with this evaluation data, the refill control device 60 causes the operating conditions in the printing apparatus to be stored in the semiconductor memory device 32.

The operation of the reproducing device of this construction will now be described with reference to a flow chart shown in FIG. 10.

When the ink cartridge 10' is set on a working pallet 67 (Step A), the reproducing control device 60 reads the data from the semiconductor memory device 32 through the access means 61 (Step B), and it is judged whether or not the number of reproductions of this ink cartridge is less than a predetermined number (for example, 10) (Step C), whether or not the time period after the manufacture is less than a predetermined period (for example, 10 years) (Step D), whether or not the time period after the latest ink end is less than a predetermined period (for example, 200 days) (Step E), and whether or not the ink cartridge has been used in a predetermined environment (Step F). If all of these judgments are satisfied, it is indicated that the re-use of the cartridge is possible (Step G), and the reproduction processing is effected (Step H). On the other hand, if any of these requirements is not satisfied, it is indicated that the re-use of the cartridge is impossible, and there is given an instruction to discard this ink cartridge.

Figure 11:
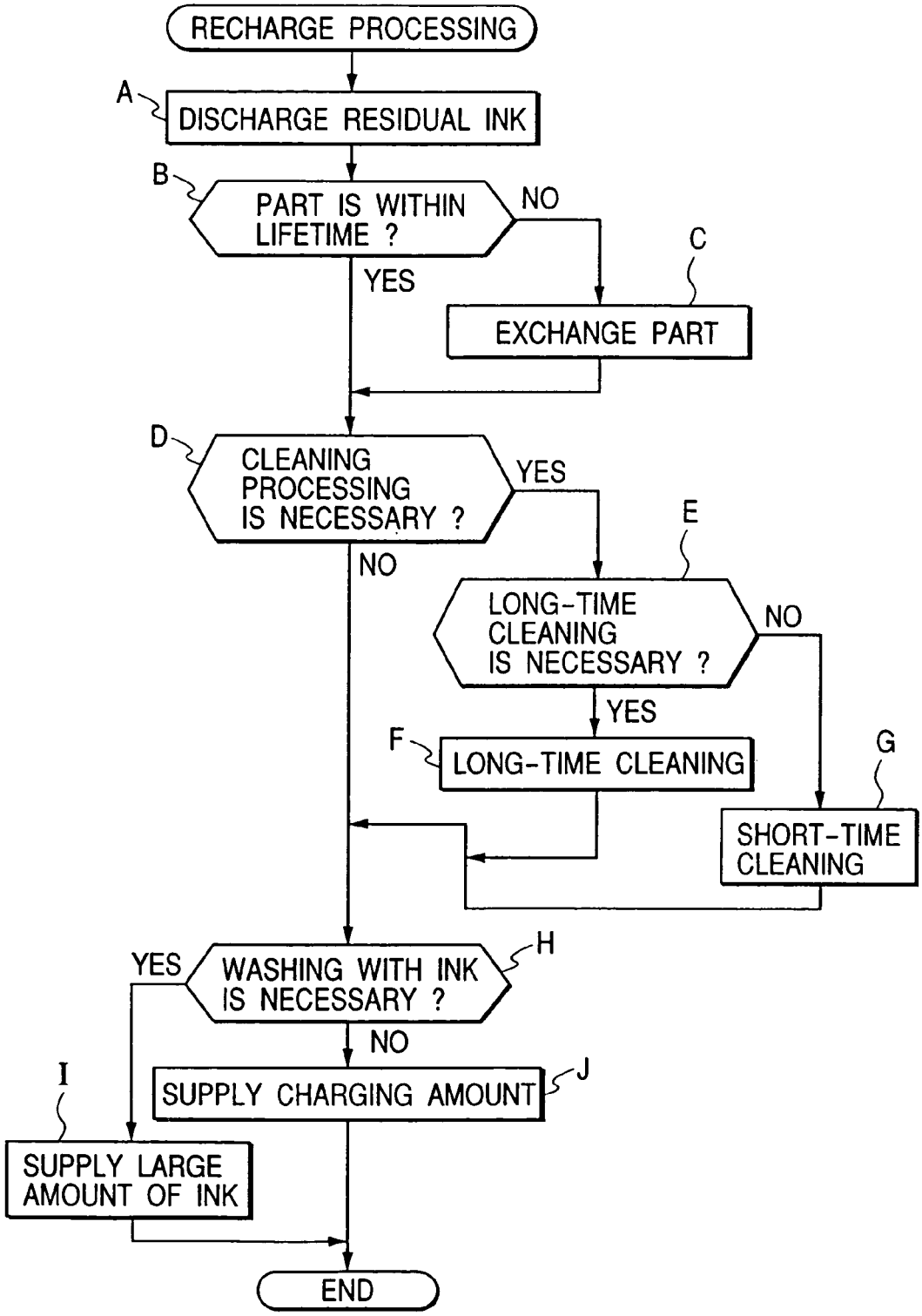
FIG. 11 is a flow chart showing a charging process by the ink refilling device.

The cartridge, which satisfies the reproduction requirements, is transferred to the ink discharge means 63 by the pallet 67, and the ink, remaining in the cartridge, is discharged therefrom by suction or the like (Step A in FIG. 11). The reproducing control device 60 judges from the data, read from the ink cartridge whether or not the part (for example, a packing fitted in the ink supply port) reaches the limit of the lifetime (Step B in FIG. 11), and the necessary part is exchanged by the parts exchange means 64 (Step C in FIG. 11).

Then, in view of the lapse of time after the latest ink end, it is judged whether or not the cleaning is necessary (Step D in FIG. 11), and in accordance with this time period, the time of cleaning by the cleaning means 65, that is, the degree of cleaning, is determined (Steps E to G in FIG. 11).

When the pretreatments necessary for the reproduction are finished, the reproducing control device 60 judges whether or not the ink cartridge should be washed with ink to be charged (This is necessary because a change in the composition of the ink for the color ink cartridge subtly influences the printing quality) (Step H in FIG. 11), and if this is necessary, a large amount of ink is supplied to the ink charge means 66, and a predetermined amount of the ink is discharged from the ink cartridge, thereby washing the ink cartridge with the ink to be refilled, and a predetermined amount of the ink is charged into the ink cartridge (Step I in FIG. 11). If the washing with the ink is not necessary, a predetermined amount of the ink is supplied and charged into the ink cartridge (Step J in FIG. 11).

Figure 10:
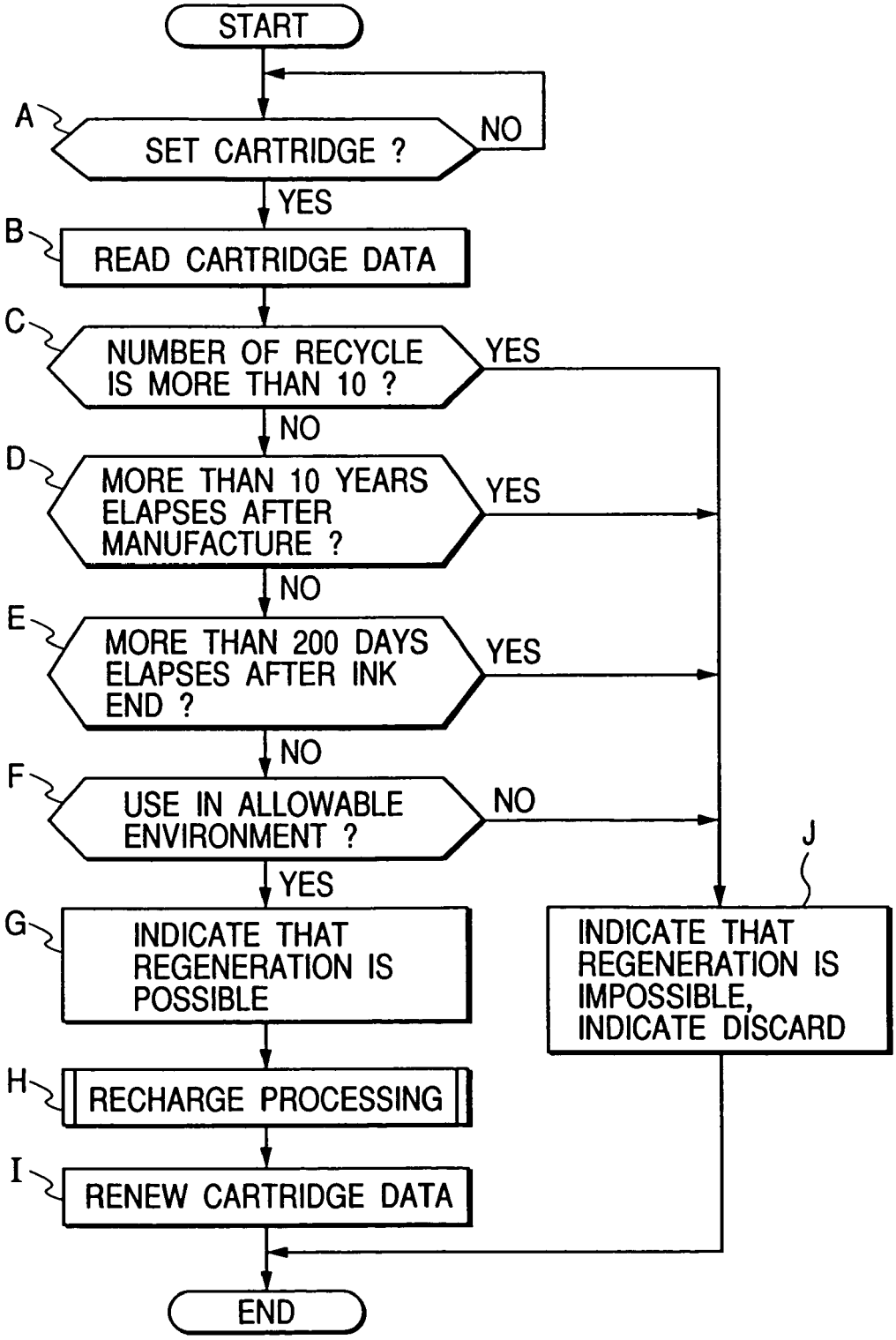
FIG. 10 is a flow chart showing the overall operation of the ink refilling device.

After the ink filling is finished, the cartridge data, such as the necessary information ((1) The date of reproduction, (2) the number of the reproduction, (3) The exchange of the part and its name, and optionally (4) a method of charging the ink into the print head, depending on the number of reproduction, and the amount of drawing of ink)), are stored in the semiconductor memory device 32 of the refilled ink cartridge under the control of the reproduction control device 60 (Step I in FIG. 10).

Thus, the history of the reproduced cartridge, refilled with the ink, is clear, and the operation of the printing apparatus is ensured by the data related to the operating method required because of its difference from the virgin ink cartridge.

As described above, according to the present invention, there is provided the memory device having the areas in which the data, related to the history of use of the ink cartridge, can be stored in a rewritable manner, and therefore the refill processing can be effected at the refill process in view of the conditions of use of the ink cartridge by the user, and the recycle can be effected in a highly-reliable manner.

What is claimed is:

1. An ink cartridge for an ink jet type printing apparatus having a print head, the ink cartridge comprising:

a container having an ink chamber for containing ink therein;

an ink supply port for supplying the ink from said ink chamber to the print head; and a memory device formatted to store data indicative of the history of the ink cartridge, data indicative of past environment of use of the ink cartridge, and data indicative of past cleaning of the print head, said memory device having an area in which the data is stored in a rewritable manner.

2. An ink cartridge according to claim 1, wherein the data includes data related to the number of reproduction times of the ink cartridge.

3. An ink cartridge according to claim 1, wherein the data includes data related to the time of final use of the ink cartridge.

4. An ink cartridge according to claim 1, wherein said memory device stores data indicative of the date of manufacture of the ink cartridge.

5. An ink cartridge according to claim 1, wherein said memory device stores data indicative of a lifetime of the ink cartridge.

6. An ink cartridge according to claim 1, wherein said memory device stores data indicative of the time of final use of the ink cartridge.

7. An ink cartridge according to claim 1, wherein said memory device stores data indicative of the number of reproductions of the ink cartridge which can be effected.

8. An ink cartridge for an ink jet type printing apparatus having a print head, the ink cartridge comprising:

a container having an ink chamber for containing ink therein;

an ink supply port for supplying the ink from said ink chamber to the print head;

a memory device formatted to store data indicative of the history of the ink cartridge, said memory device having an area in which the data is stored in a rewritable manner; and wherein the data includes data indicative of past maintenance processing required for use in a reproduction of the ink cartridge.

9. An ink cartridge for an ink jet type printing apparatus having a print head, the ink cartridge comprising:

a container having an ink chamber for containing ink therein;

an ink supply port for supplying the ink from said ink chamber to the print head;

a memory device formatted to store data indicative of the history of the ink cartridge, said memory device having an area in which the data is stored in a rewritable manner; and wherein the data includes data indicative of past maintenance processing required for use in a reproduction of the ink cartridge;

wherein the data includes data indicative of a past condition of cleaning.

10. An ink cartridge for an ink jet type printing apparatus having a print head, the ink cartridge comprising:

a container having an ink chamber for containing ink therein;

an ink supply port for supplying the ink from said ink chamber to the print head;

a memory device formatted to store data indicative of the history of the ink cartridge, said memory device having an area in which the data is stored in a rewritable manner;

wherein the data includes data indicative of a maintenance processing required for use in a reproduction of the ink cartridge; and wherein the data includes data indicative of a condition of exchange of a part of the ink cartridge.

11. An ink cartridge for an ink jet type printing apparatus having a print head, the ink cartridge comprising:

a container having an ink chamber for containing ink therein;

an ink supply port for supplying the ink from said ink chamber to the print head;

a memory device formatted to store data indicative of the history of the ink cartridge, said memory device having an area in which the data is stored in a rewritable manner;

wherein the data includes data indicative of the time of final ink depletion of the ink cartridge; and wherein the data includes data indicative of past maintenance processing required for use in a reproduction of the ink cartridge.

12. An ink cartridge for an ink jet type printing apparatus having a print head, the ink cartridge comprising:

a container having an ink chamber for containing ink therein;

an ink supply port for supplying the ink from said ink chamber to the print head;

a memory device formatted to store data indicative of the history of the ink cartridge, said memory device has an area in which the data is stored in a rewritable manner; and wherein the data includes data indicative of a past environment in which the ink cartridge was used.

13. An ink cartridge for an ink jet type printing apparatus having a print head, the ink cartridge comprising:

a container having an ink chamber for containing ink therein;

an ink supply port for supplying the ink from said ink chamber to the print head; and a memory device for storing data related to the ink or the ink cartridge, said memory device storing therein data relating to a minimum ink amount to be contained in the ink cartridge, said memory device having an area in which data indicative of a residual ink amount is stored in a rewritable manner;

wherein said ink cartridge is operable to alter an ink discharge operation during cleaning of the print head based on the stored data relating to the minimum ink amount and the residual ink amount.

14. An ink-jet printing apparatus comprising:

a print head for ejecting ink droplets;

an ink cartridge containing ink therein for supplying the ink to said print head;

a memory device storing data related to the ink cartridge, data related to past environment of use of the ink cartridge, and data related to past cleaning of the print head;

a control device accessible to said memory device for controlling said print head in accordance with data supplied from the exterior, said control device controlling a charging of the ink into said print head in accordance with data, stored in said memory device, when said ink cartridge is attached to the printing apparatus; and said control device determines whether the print head needs cleaning and controls the cleaning operation.

15. An ink-jet printing apparatus according to claim 14, wherein said control device judges from the data in said memory device whether or not the attached ink cartridge is a reproduced one.

16. An ink-jet printing apparatus according to claim 14, wherein the control of the ink charging operation is directed to the amount of ink drawn.

17. An ink-jet printing apparatus according to claim 14, wherein said control device causes data, related to the conditions of use of said ink cartridge, to be stored in said memory device when said ink cartridge is to be detached from the printing apparatus.

18. An ink-jet printing apparatus according to claim 17, wherein said data, related to said conditions of use, is the time of ink depletion of said ink cartridge.

19. An ink-jet printing apparatus according to claim 17, wherein said data, related to said conditions of use, is conditions of maintenance of said print head during the time when said ink cartridge is attached to the printing apparatus.

20. An ink-jet printing apparatus according to claim 17, wherein said data, related to said conditions of use, is data related to an environment during the time when said ink cartridge is attached to the printing apparatus.

21. An ink-jet printing apparatus according to claim 14, wherein said control device judges from the data, stored in said memory device, whether or not a next reproduction of the ink cartridge is possible.

22. An ink-jet printing apparatus according to claim 21, wherein said judgment is made in accordance with the number of reproductions, a lifetime, a time period after detection of ink depletion, and an environment of use.

23. An ink-jet printing apparatus according to claim 14, wherein said control device judges whether or not the next reproduction of the ink cartridge is possible in accordance with the data stored in said memory device, and the control device displays an indication that the ink cartridge is to be discarded when it judges that the reproduction is impossible.

24. An ink-jet printing apparatus according to claim 14, wherein said control device judges whether a next reproduction of the ink cartridge is possible in accordance with the data stored in said memory device, and the control device displays that the ink cartridge is discarded if it judges that the reproduction is impossible.

25. An ink-jet printing apparatus comprising:

a print head for ejecting ink droplets;

an ink cartridge containing ink therein for supplying the ink to said print head;

a memory device storing data representative of a preset minimum ink amount and residual ink in the ink cartridge; and a control device accessible to said memory device for controlling said print head in accordance with data supplied from the exterior, said control device judging whether a cleaning operation is necessary in accordance with the data stored in said memory device.

26. An ink-jet printing apparatus according to claim 25, wherein said control device executes the cleaning operation when the residual ink amount is greater than the sum of the preset minimum amount of ink and an amount of ink which is consumed by the cleaning operation.

27. An ink-jet printing apparatus according to claim 25, wherein said control device executes a brief cleaning operation when the residual ink amount is the preset minimum ink amount but less than the sum of the preset minimum ink amount and an ink amount which is consumed by the cleaning operation.

28. A cartridge reproducing device for an ink cartridge for an ink jet type printing apparatus having a print head, the reproducing device comprising:

means for reading data, related to a history of use of the ink cartridge to be reproduced, from a memory device provided on the ink cartridge;

a control device which controls a reproduction processing apparatus in accordance with said data, and causes at least data, representing the number of reproductions and the time of reproduction, to be stored in said memory device after the reproducing operation is finished; and said control device determines when and if the print head needs cleaning and controls the cleaning.

29. A reproducing device according to claim 28, wherein said control device causes data, related to conditions of maintenance of the ink cartridge, to be stored in the memory device after the reproducing operation is finished.

30. A reproducing device according to claim 28, wherein said reproduction processing apparatus includes at least a cartridge cleaning device, and an ink injecting device.

31. A reproducing device according to claim 28, wherein said control device judges from the data in the memory device whether or not the reproduction is possible.

32. A reproducing device according to claim 28, wherein said control device controls the degree of cleaning by cleaning means in accordance with the data in said memory device.

33. A reproducing device for an ink cartridge according to claim 28, wherein said control device effects a washing of the ink cartridge with ink to be reproduced in accordance with the data in the memory device.

34. The cartridge reproducing device according to claim 28, wherein said memory device is provided on a circuit board containing electrical contacts for contacting with said ink jet type printing apparatus, said memory device provided on a surface of said circuit board that is opposite to a surface containing said electrical contacts.

35. An ink-jet printing apparatus comprising:

a print head for ejecting ink droplets;

an ink cartridge containing ink therein for supplying the ink to said print head;

a memory device storing data related to the ink cartridge, data related to environment of use of the ink cartridge, and data related to cleaning of the print head; and a control device accessible to said memory device for controlling said print head in accordance with data supplied from the exterior, said control device judges, from the data stored in said memory device, whether the next reproduction of the ink cartridge is possible.

36. An ink jet printing apparatus according to claim 35, wherein, wherein said control device causes data, related to the conditions of use of said ink cartridge, to be stored in said memory device when said ink cartridge is to be detached from the printing apparatus.

37. A method of operating a printing ink cartridge reproducing device having a data memory device, a reproducing control device, an ink charging device and an ink discharge device, said method comprising:

reading ink cartridge data from an ink cartridge having an ink memory circuit;

evaluating the ink cartridge data using the reproducing control device;

determining whether regeneration of the ink cartridge is possible; and recharging the ink cartridge using the ink charging device if the reproducing control device determines that regeneration of the ink cartridge is possible.

38. The method of operating a printing ink cartridge reproducing device of claim 36 wherein recharging the ink cartridge comprises:

discharging residual ink from the ink cartridge using the ink discharge device;

determining whether a part of the ink cartridge needs to be replaced using the reproducing control device;

replacing the part of the ink cartridge that needs to be replaced;

determining whether cleaning of the ink cartridge is needed by the reproducing control device;

cleaning the ink cartridge if the reproducing control device determines that the ink cartridge needs to be cleaned;

determining whether the ink cartridge needs to be washed with ink using the reproducing control device; and washing the ink cartridge if the reproducing control device determines that the ink cartridge needs to be washed with ink.

39. The method of operating a printing ink cartridge reproducing device of claim 38 wherein the reproducing control device uses data stored in the data memory device and data stored in the ink memory circuit.

40. The method of operating a printing ink cartridge reproducing device of claim 38 wherein the reproduction control device is within a printer.

41. The method of operating a printing ink cartridge reproducing device of claim 38 wherein the reproduction control device is within a computer.

42. The apparatus according to any one of claims 14 to 27 and 35 to 24, wherein the memory device is disposed on the ink cartridge.

43. The method of operating a printing ink cartridge reproducing device according to claim 37, wherein the reproducing control device reads the ink cartridge data from the ink memory circuit which is provided on a circuit board containing electrical contacts for contacting with a printing apparatus, the ink memory circuit provided on a surface of the circuit board that is opposite to a surface containing the electrical contacts.

* * * * *